US011230849B1

(12) United States Patent
Smith

(10) Patent No.: US 11,230,849 B1
(45) Date of Patent: Jan. 25, 2022

(54) OUTRIGGER FOR MULTI-FUNCTION SCAFFOLD

(71) Applicant: Grady F. Smith, Greenville, NC (US)

(72) Inventor: Grady F. Smith, Greenville, NC (US)

(73) Assignee: Grady F. Smith, Greenville, NC (US)

( * ) Notice: Subject to any disclaimer, the term of this patent is extended or adjusted under 35 U.S.C. 154(b) by 0 days.

(21) Appl. No.: 17/219,146

(22) Filed: Mar. 31, 2021

(51) Int. Cl.

| | |
|---|---|
| ***E04G 1/24*** | (2006.01) |
| ***E04G 5/00*** | (2006.01) |
| ***E04G 1/22*** | (2006.01) |
| ***E04G 1/30*** | (2006.01) |
| *E06C 7/42* | (2006.01) |

(52) U.S. Cl.
CPC ..... *E04G 5/001* (2013.01); *E04G 1/22* (2013.01); *E04G 1/24* (2013.01); *E04G 1/30* (2013.01); *E04G 2001/242* (2013.01); *E04G 2001/305* (2013.01); *E06C 7/423* (2013.01)

(58) Field of Classification Search
CPC ..... E04G 1/30; E04G 5/001; E04G 2001/242; E04G 2001/305; E04G 1/24; E06C 7/423
See application file for complete search history.

(56) References Cited

U.S. PATENT DOCUMENTS 2,897,013 A * 7/1959 Delp ..... E04G 7/305 52/645
3,012,628 A * 12/1961 Zumbaum ..... E06C 7/423 182/172
3,612,219 A * 10/1971 Fortner ..... E04G 1/20 182/126
4,147,231 A * 4/1979 Chantier ..... E06C 7/423 182/107
4,519,477 A * 5/1985 Ralston ..... E06C 7/423 182/107
4,632,220 A * 12/1986 Murrell ..... E06C 7/44 182/111
4,641,728 A * 2/1987 McCabe ..... E04G 1/20 182/132
4,798,262 A * 1/1989 Margolies ..... E06C 1/20 182/106
5,588,500 A * 12/1996 Yonahara ..... E04G 1/22 182/141
5,819,872 A * 10/1998 Krause ..... E04G 1/24 182/17
6,863,155 B2 * 3/2005 Wyse ..... E04G 1/24 182/118

(Continued)

FOREIGN PATENT DOCUMENTS

DE 29714266 U1 * 10/1997 ..... E04G 7/14
DE 10107781 A1 * 9/2002 ..... E04G 1/30

(Continued)

*Primary Examiner* — Colleen M Chavchavadze
(74) *Attorney, Agent, or Firm* — Coats & Bennett, PLLC

(57) ABSTRACT

A lightweight, multi-function scaffold includes an adjustable height platform that slidably mounts between two ladder frames and a plurality of outriggers to increase stability. The outriggers attach to the ladder frames of the scaffold and extend beyond an end of the scaffold in the longitudinal direction to increase the maximum base width. Increasing the maximum base width increases stability in the longitudinal dimension and reduces the risk of tipping the scaffold end over end when a user climbs the ladder frame to access the platform.

9 Claims, 9 Drawing Sheets

(56) References Cited

U.S. PATENT DOCUMENTS

| | | | | |
|---|---|---|---|---|
| 2011/0067954 | A1* | 3/2011 | Deal | E06C 7/423<br>182/107 |
| 2019/0055784 | A1* | 2/2019 | Kazanjian | E06C 7/423 |
| 2020/0149348 | A1* | 5/2020 | Khwaja | E06C 7/488 |

FOREIGN PATENT DOCUMENTS

| | | | | |
|---|---|---|---|---|
| EP | 1783302 | A2 * | 5/2007 | E04G 1/24 |
| EP | 3192942 | B1 * | 9/2018 | E04G 5/16 |
| JP | 2005076348 | A * | 3/2005 | E04G 1/24 |

* cited by examiner

OUTRIGGER FOR MULTI-FUNCTION SCAFFOLD

TECHNICAL FIELD

The present disclosure relates generally to lightweight scaffolding and, more particularly, to outriggers for lightweight, multi-function scaffolds to increase stability of the scaffold.

BACKGROUND

Lightweight scaffolds made from metal tubing are commercially available for use when working close to the ground. One such scaffold comprises an adjustable height platform supported between two ladder frames. The platform includes two side rails with guide channels at each end that slide up and down along the vertical supports of the ladder frames. Casters insert into the lower ends of the vertical supports so that the scaffold can roll on the floor or other support surface.

A potential hazard when using a free-standing scaffold is tipping. Tipping can occur, for example, when a user leans over the edge of the scaffold while performing some task. It is known to use outriggers to increase the minimum base width of the scaffold and reduce or prevent sideways tipping. Generally, the outriggers attach to the ladder frame and extend laterally out perpendicular the longitudinal axis of the scaffold to increase the minimum base width of the scaffold. The wider base provided by the outrigger reduces the tipping hazard when a worker leans over the edge of the scaffold.

Tipping can also occur when a user is climbing the ladder frame at one end of the scaffold. If the user's body weight is too far from the frame when the user is climbing, the scaffold may tip over end-to-end. This hazard is particularly dangerous because the scaffold will tip towards the user and could crash down on top of the user. The risk of tipping is highest when used in single-height mode, i.e., a single unit. The risk is reduced when the scaffolds are stacked. In this case, the weigh to of the scaffolds stacked together counterbalances the user's weight. Current OSHA regulations do not address this issue and there is no outrigger on the market available to increase the maximum base width of the scaffold.

SUMMARY

The present disclosure provides an outrigger for a lightweight, multi-purpose scaffold that improves stability of the scaffold. The scaffold includes a pair of ladder frames and an adjustable height platform mounted between the ladder frames. The outriggers can attach to the ladder frames in either a first or a second orientation to provide a wider base for the scaffold and thereby increase stability in two dimensions. The outrigger provides increased stability in the longitudinal dimension and reduces the risk of tipping the scaffold end over end when a user climbs the ladder frame to access the platform.

In one embodiment, the outrigger comprises a riser configured to attach to a vertical support of the ladder frame in both a first orientation and a second orientation, an outrigger arm extending outwardly from the riser, and a sleeve for mounting a ground-engaging member mounted at an outer end of the outrigger arm. When connected in a first orientation, the outrigger arm extends at an angle greater than 0 degrees and less than 45 degrees relative to the transverse plane of the scaffold. When mounted in a second orientation, the outrigger arm extends at an angle greater than 45 degrees relative to the transverse plane of the scaffold.

In another embodiment, the outrigger comprises a riser configured to attach to a vertical support of the ladder frame, an outrigger arm extending outwardly from the riser at an angle relative to a transverse plane such that, when the outrigger is mounted to one of the vertical supports, an outer end of the outrigger extends outward beyond an end of the scaffold in the longitudinal direction, and a sleeve connected to the outer end of the outrigger arm configured for mounting a ground-engaging member.

Other embodiments comprise a multi-function scaffold with an outrigger. The scaffold comprises first and second ladder frames, each ladder frame comprising two vertical supports made of a tubular material connected by two or more cross members and an adjustable height platform configured to be supported between the first and second ladder frames at a user selected height. The outriggers are configured for attachment to respective vertical supports of the ladder frames. Each outrigger comprises a riser configured to attach to a vertical support of the ladder frame, an outrigger arm extending outwardly from the riser at an angle relative to a transverse plane such that, when the outrigger is mounted to one of the vertical supports, an outer end of the outrigger extends outward beyond an end of the scaffold in the longitudinal direction, and a sleeve connected to the outer end of the outrigger arm configured for mounting a ground-engaging member.

DETAILED DESCRIPTION

Figure 1:
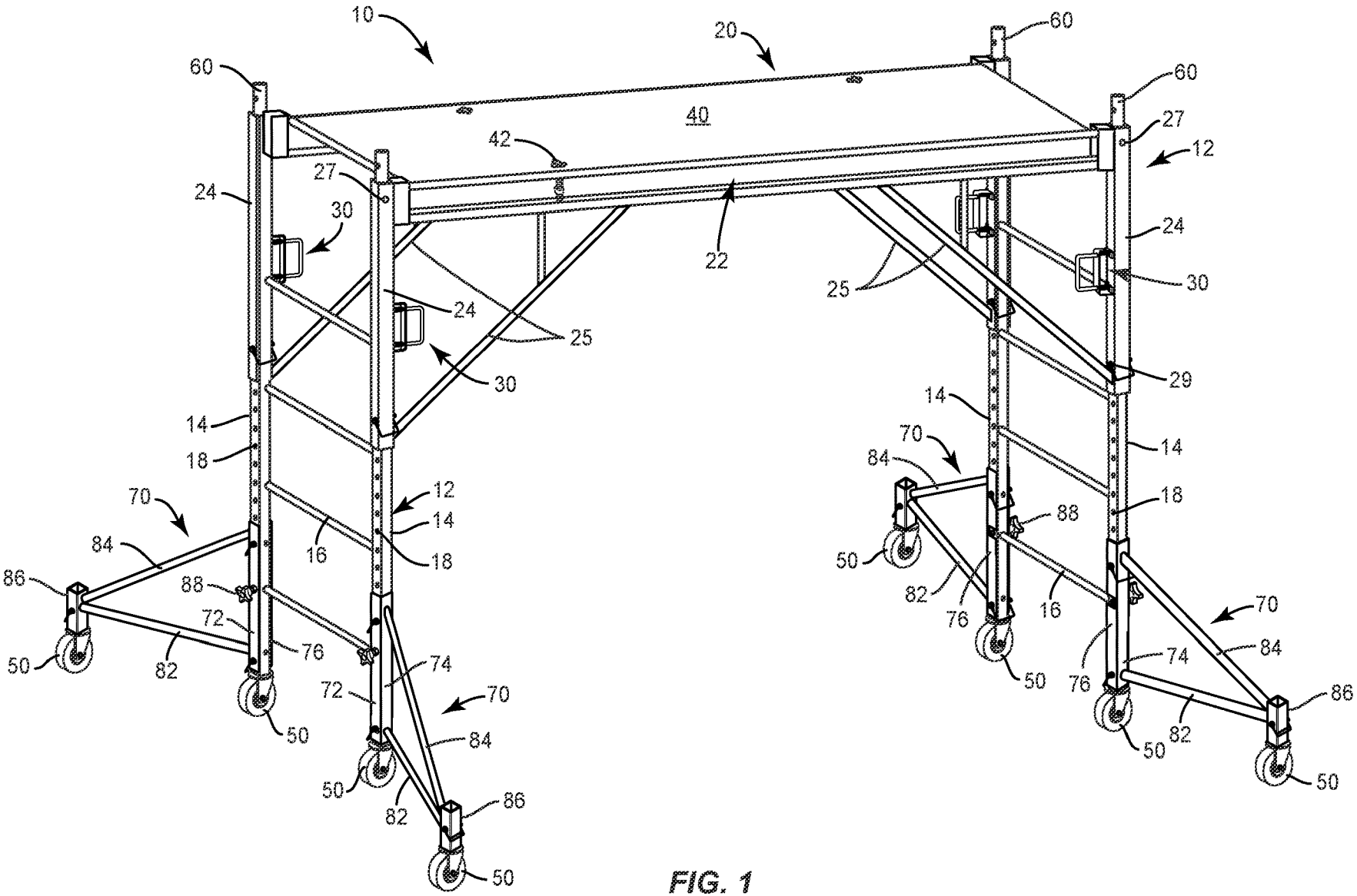
FIG. 1 is a perspective view of a scaffold including two ladder frames and an adjustable height platform according to one exemplary embodiment.
Figure 2:
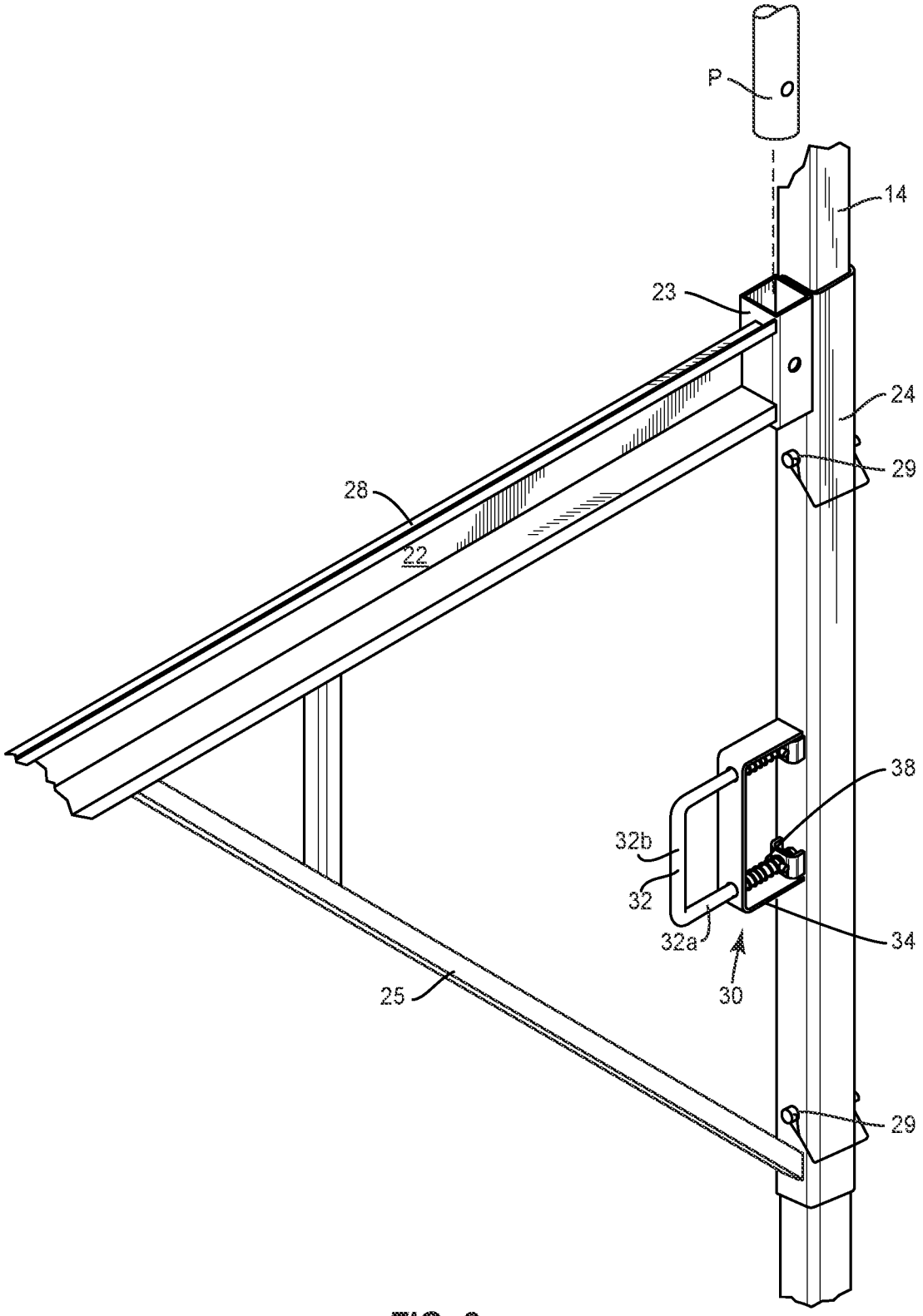
FIG. 2 is a partial perspective view of a side rail and guide channel for the adjustable height platform.

Referring now to the drawings, FIG. 1 illustrates a multi-purpose scaffold 10 according to an exemplary embodiment. The multi-purpose scaffold 10 comprises two ladder frames 12, an adjustable height platform 20 supported between the two ladder frames 12 and a plurality of outriggers 70 for increasing the stability of the scaffold 10.

Figure 3A:
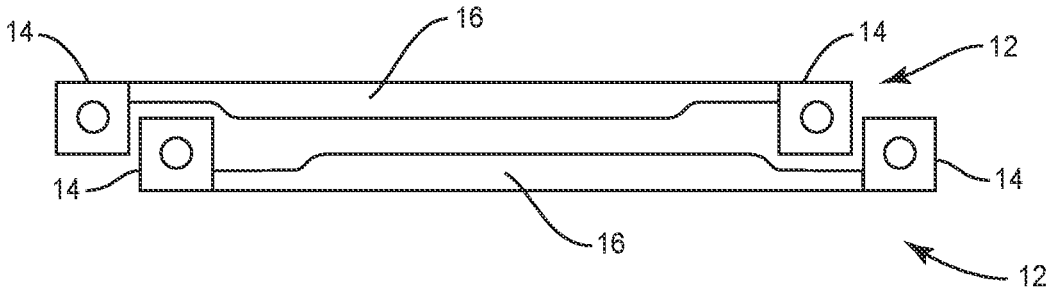
FIG. 3A illustrates compact stacking of two ladder frames for shipment or storage.

Each ladder frame 12 comprises two vertical supports 14 connected by two or more cross members 16 forming a ladder. The vertical supports 14 and cross members 16 are preferably made of a metal tubing or other tubular material. The cross members 16 are preferably welded at each end to respective ones of the vertical supports 14 so that each ladder frame 12 is a unitary structure. In one embodiment, the vertical supports 14 have a square or rectangular cross-section and the cross members 16 have a circular cross-section. The outside diameter of the cross members 16 is less than the width of the vertical support 14. The cross members 16 can be offset from the center of the vertical supports 14 and the ends of the cross members 16 can be crimped or compressed to facilitate more compact stacking as shown in FIG. 3A.

A series of aligned openings 18 extend through the vertical supports 14 perpendicular to the plane of the ladder frame 12 and are spaced 2 inches apart. As will be hereinafter described in more detail, the openings 18 are engaged by a releasable locking mechanism 30 on the platform 20 to secure the platform 20 at a desired height between the ladder frames 12. Additionally, openings 18*a* extend transversely through the lower end of each vertical support 14. These opening 18*a* are used to secure the outriggers 70 as will be hereinafter described.

The platform 20 comprises two side rails 22 that extend between the ladder frames 12 and a deck 40 that is supported by the side rails 22. As seen best in FIG. 4, the side rails 22 connect at each end to a C-shaped guide channel 24 sized to fit around the vertical supports 14 of the ladder frames 12. In some embodiments, a square sleeve 23 is interposed between the end of the side rail 22 and the guide channel 24 for mounting a safety rail to the platform 20. The sleeve 23 is configured to receive posts P of the safety rail (not shown), which can be secured to the sleeve 23 by span pins (not shown). In one embodiment, the side rail 22, sleeves 23 at each end thereof, and the guide channels 24 are welded together to form a unitary structure. Diagonal braces 25 extend between the side rails 22 and the guide channels 24 to increase rigidity of the structure.

The guide channels 24 are configured to slide along the vertical supports 14 of the ladder frames 12 at each end of the scaffold 10 to adjust the height of the platform 20. A releasable locking mechanism 30 on the guide channel is provided to lock the platform 20 at a desired height. Generally, the releasable locking mechanism 30 comprises a U-shaped span pin 32 that is supported by a bracket 34 and engages with the openings 18 in the vertical supports 14 to lock the side rail 22 at a desired height. The span pin 32 includes a pair of spaced apart legs 32*a* connected by a cross member 32*b* and is biased to a locking position by springs 38. The springs 38 are compressed when the span pin 32 is pulled back to disengage the span pin 32 and push the span pin 32 back to an engaged position when the span pin 32 is released.

Figure 3B:
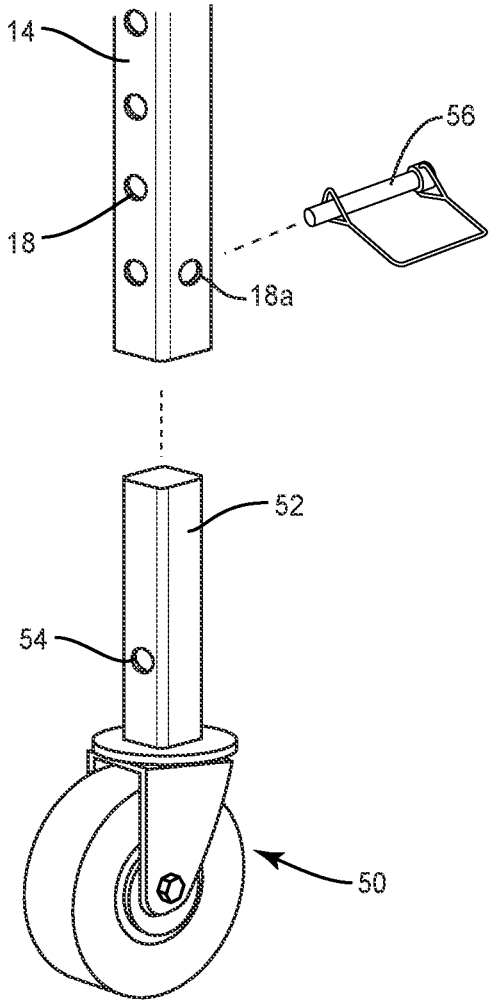
FIG. 3B is an exploded perspective view showing a portion of the ladder frame and a caster.

In some embodiments, the scaffold 10 includes casters 50 disposed at the lower end of each vertical support 14 as shown in FIG. 3B. Each caster 50 includes a stem 52 that extends into the lower end of a vertical support 14. The stem 52 of the caster 50 includes an opening 54 that is located to align with an opening 18 in the vertical support 14 when the stem 52 of the caster 50 is inserted into the vertical support 14. A span pin 56 passes through aligned openings 54 and 18 in the caster 50 and vertical support 14 respectively to secure the caster 50 to the vertical support 14.

In some embodiments, the casters 50 can be replaced by footpads, level jacks or socket levelers (not shown) or other ground-engaging member. comprising a generally flat pad that contacts the ground or underlying surface and a stem that extends into that extends into the lower end of a vertical support 14.

In some embodiments, the ladder frames 12 include stacking pins 60 at the upper ends of the vertical supports 14 for stacking the scaffolds.

When assembled, the scaffold 10 provides a free-standing, self-supporting structure. Outriggers 70 can be used with the scaffold to increase stability by providing a wider base. Conventional outriggers 70 for lightweight scaffolds are designed to extend out from the sides of the scaffold in a lateral direction, i.e., perpendicular to the longitudinal axis, to increase the minimum base width This arrangement reduces the risk of tipping sideways but does not improve stability in the longitudinal dimension.

One aspect of the present disclosure is to provide an outrigger 70 that not only improves stability in the lateral dimensions but also increases stability in the longitudinal dimension. The increased stability in the longitudinal dimension reduces the risk of tipping the scaffold 10 end over end when a user climbs the ladder frame 12 to access the platform 20. This hazard is particularly dangerous because the scaffold will tip towards the user and could crash down on top of the user. The risk of tipping is highest when used in single-height mode, i.e., a single unit. A 200 lb man exceeds the 4 to 1 safety factor OSHA standard unless he keeps his entire body within 9.8 in of the ladder when climbing the ladder which is not possible. This issue was recently discovered after commissioning a high level engineering study. The risk is reduced when the scaffolds are stacked. In this case, the weigh to of the scaffolds stacked together counterbalances the user's weight. The outrigger as described herein is configured for use with a scaffold that is not stacked and therefore reduces this tipping risk.

Another aspect of the disclosure is to provide a simple outrigger 70 that can be assembled in multiple ways with the scaffold 10 so that the degree of stability enhancement for the longitudinal and lateral dimensions can be selected by the user depending on the user's need. Preferably, the assembly of the outrigger can be achieved without tools.

Figure 4:
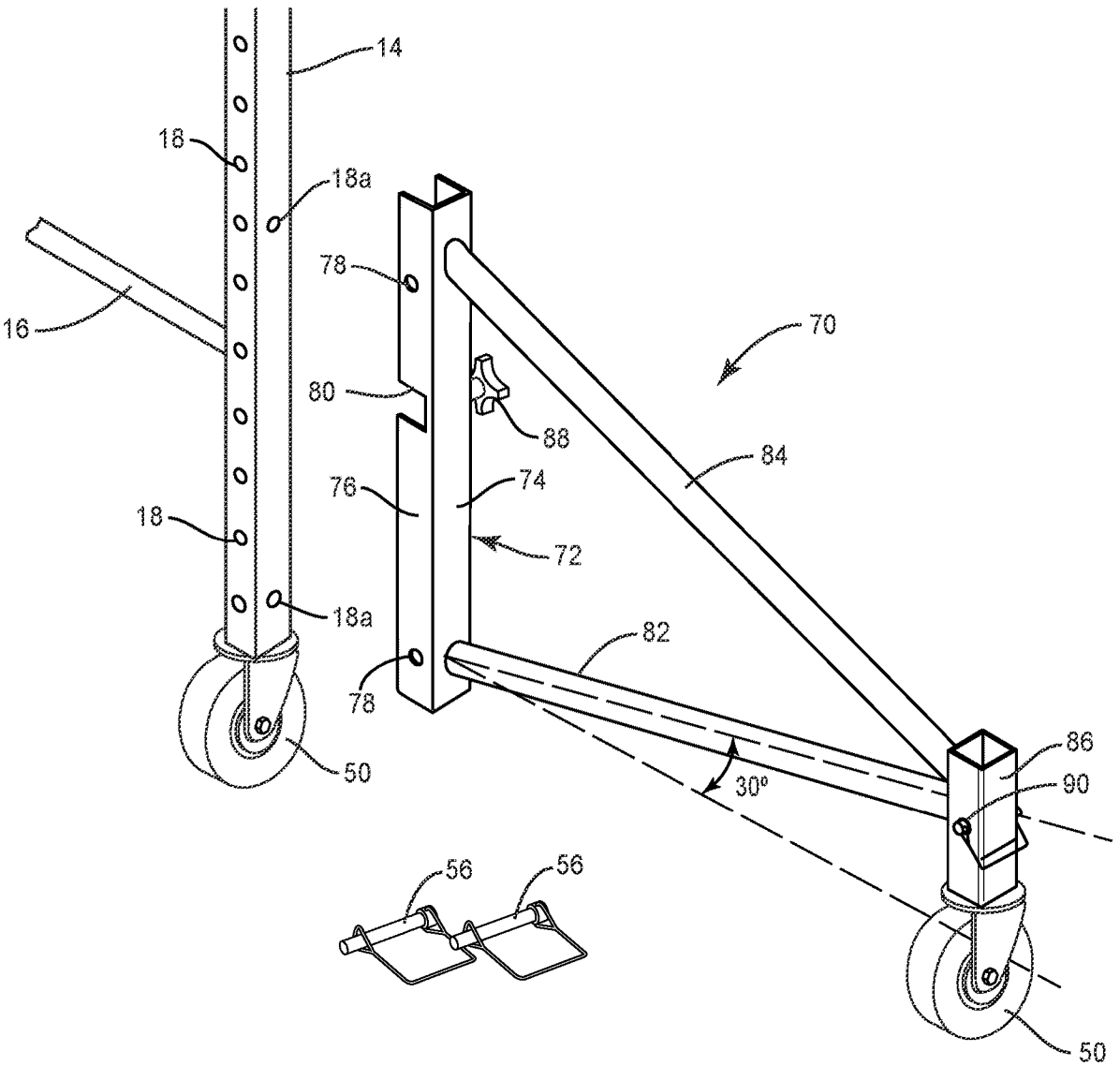
FIG. 4 is an exploded perspective view showing a portion of the ladder frame and an outrigger in a first orientation.

FIG. 4 illustrates the basic components of the outrigger 70 according to an embodiment. Each outrigger 70 generally comprises a triangular bracket that attaches to the vertical supports 14 of the ladder frames 12. The bracket comprises a generally vertical riser 72 configured to attach to a vertical support of the ladder frame, a generally horizontal outrigger arm 82 extending outward from the channel at an angle, a diagonal brace 84 and a sleeve 86 for attaching a ground-engaging member 72 such as a caster, footpad, level jack or socket leveler. The riser 72, outrigger arm 82, diagonal brace 84 and sleeve 86 are preferably made of aluminum, steel or other metal and are welded together to from a unitary bracket.

In one embodiment, the riser 72 comprises a channel configured to closely fit around the vertical supports 14 of the ladder frames 12. The channel includes a central web 74 that extends along one face of the vertical support 14 and a pair of flanges 76 extending from opposing sides thereof. The flanges 76 extend along opposing faces of the vertical support. The flanges 76 have openings 78 formed therein adjacent the top and bottom ends of the riser 72. The openings 78 in the flanges 76 align with openings 18 in the ladder frame when the outrigger 70 is mounted in a first orientation and with opening 18*a* when the outrigger 70 is attached in a second orientation. The flanges 76 of the riser 72 further include cut-outs 80 to provide clearance for the cross members (rungs) 16 of the ladder frame 12 when the outrigger 70 is in one of the first and second orientations as will be hereinafter described.

The outrigger arm 82 and diagonal brace 84 comprise tubes with a rectangular or circular cross-section. The outrigger arm 82 extends from a lower end of the riser 72 to the sleeve 86. The diagonal brace 84 extends from an upper end of the riser 72 to the sleeve 86. In a conventional outrigger 70, the outrigger arm 82 and diagonal brace 84 extend outward from the riser 72 perpendicular to the longitudinal axis of the scaffold; i.e., in a transverse plane. In the example shown in FIG. 4, the outrigger arm 82 and diagonal brace 84 extend angularly outward from the riser 72 relative to the transverse plane. The angle is greater than 0 degrees and less than 45 degrees, preferably between 10 degrees and 35 degrees and more preferably between 15 and 30 degrees. The benefit of the angle will be explained in more detail below. In the exemplary embodiment shown in the drawings, the angle is 30 degrees.

The sleeve 86 is attached to the outrigger arm 82 and diagonal brace 84 and defines the terminal end of the outrigger 70. The sleeve 86 comprises a short tube segment with a rectangular cross-section although other shapes could also be used. The sleeve 86 is designed to receive a caster, footpad, level jack or socket leveler.

The outrigger 70 is designed to attach to the ladder frame 12 in either a first orientation or a second orientation. The outrigger 70 is secured to the vertical supports 14 of the ladder frame 12 in both the first and second orientations by span pins 56 that pass through the openings 78 in the channel 74. In the first orientation, the openings 78 in the flanges 76 align with a first set of openings 18 in the vertical supports 14 of the ladder frames 12. In the second orientation, the openings 78 in the flanges 76 align with a second set of openings 18*a* in the vertical supports 14 of the ladder frames 12. Additionally, a locking screw 88 with a knob for turning by hand can be provided that tightens against the vertical support 14 when the outrigger 70 is connected to the vertical support 14 of the ladder frame 12. The locking screw 88 is threadably engaged with an opening (not shown) in one of the flanges 76 of the channel 72. When tightened, the locking screw 88 presses the vertical support 14 against an inner surface of the opposing flange 76 to remove play between the channel 72 and vertical support 14.

Figure 5:
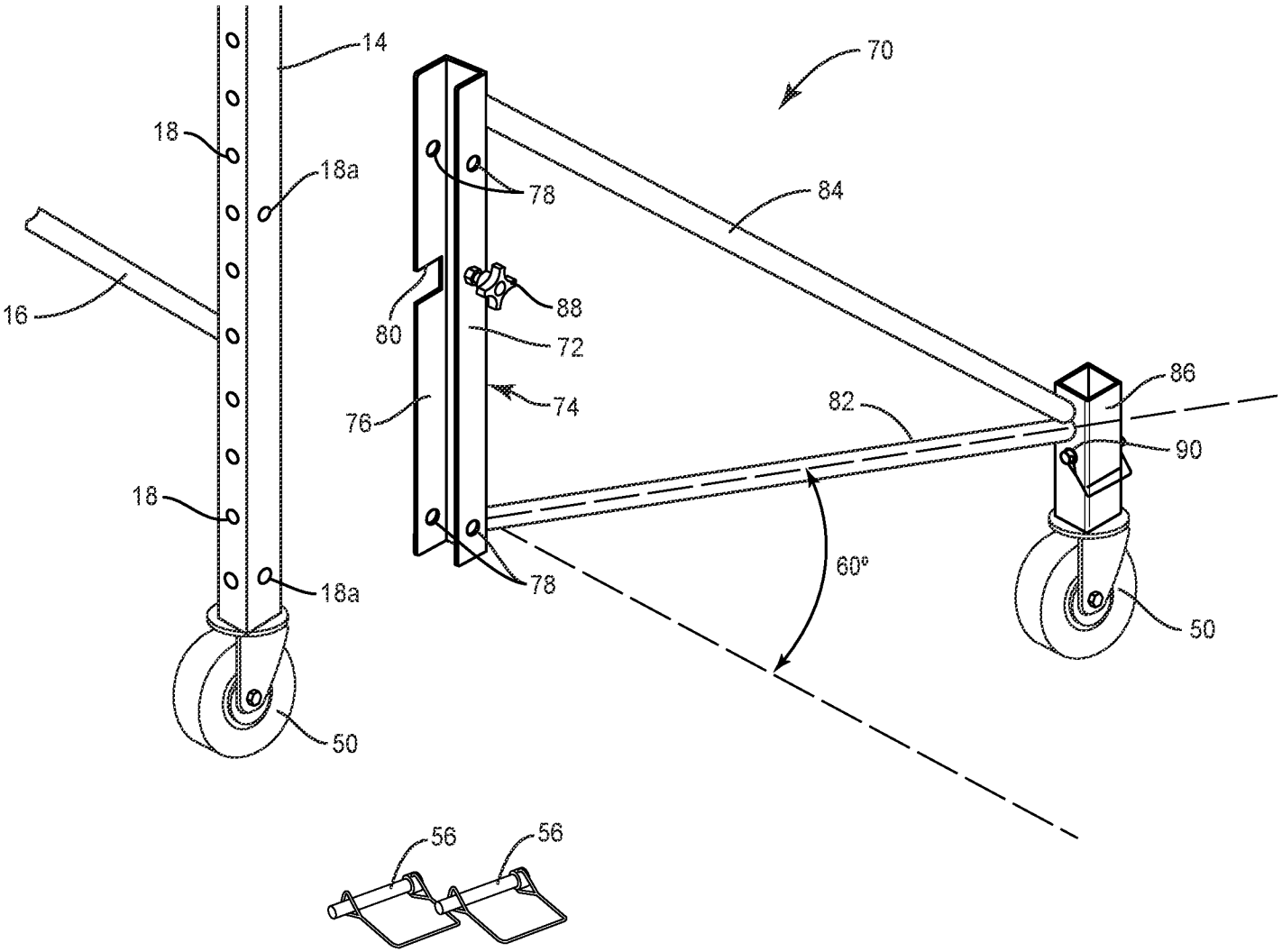
FIG. 5 is an exploded perspective view showing a portion of the ladder frame and an outrigger in a second orientation.
Figure 6:
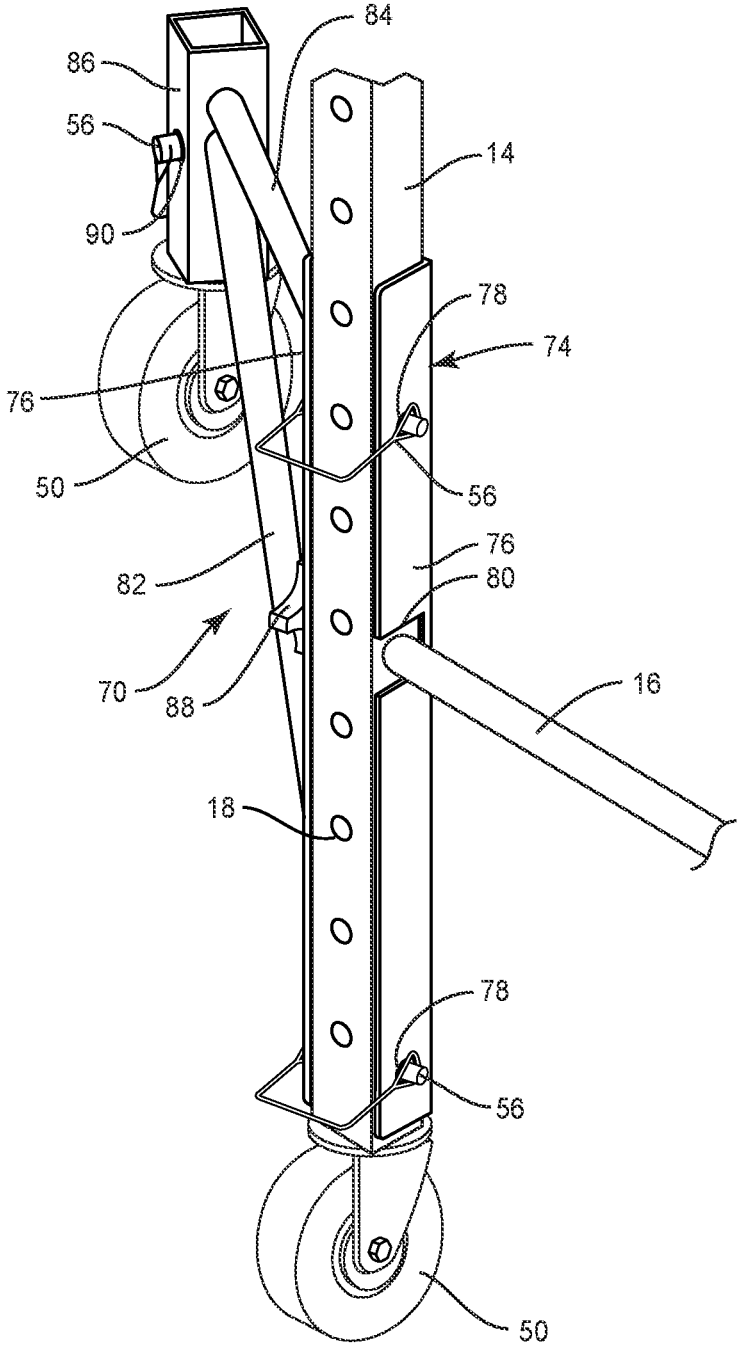
FIG. 6 is a perspective view from a different viewpoint showing a portion of the ladder frame and an outrigger in a second orientation.
Figure 7:
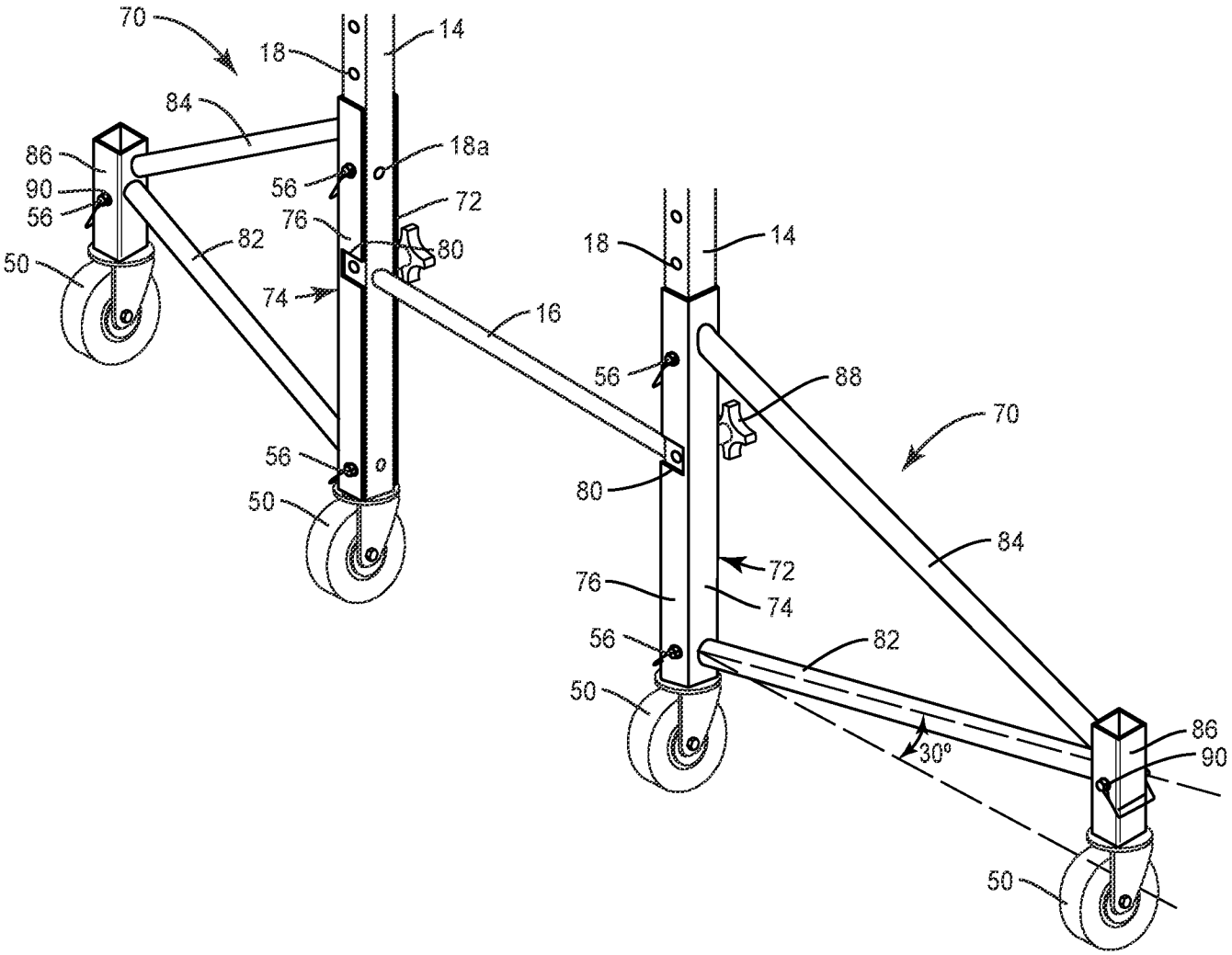
FIG. 7 is a perspective view showing a pair of outriggers attached to a ladder frame in a first orientation.
Figure 8:
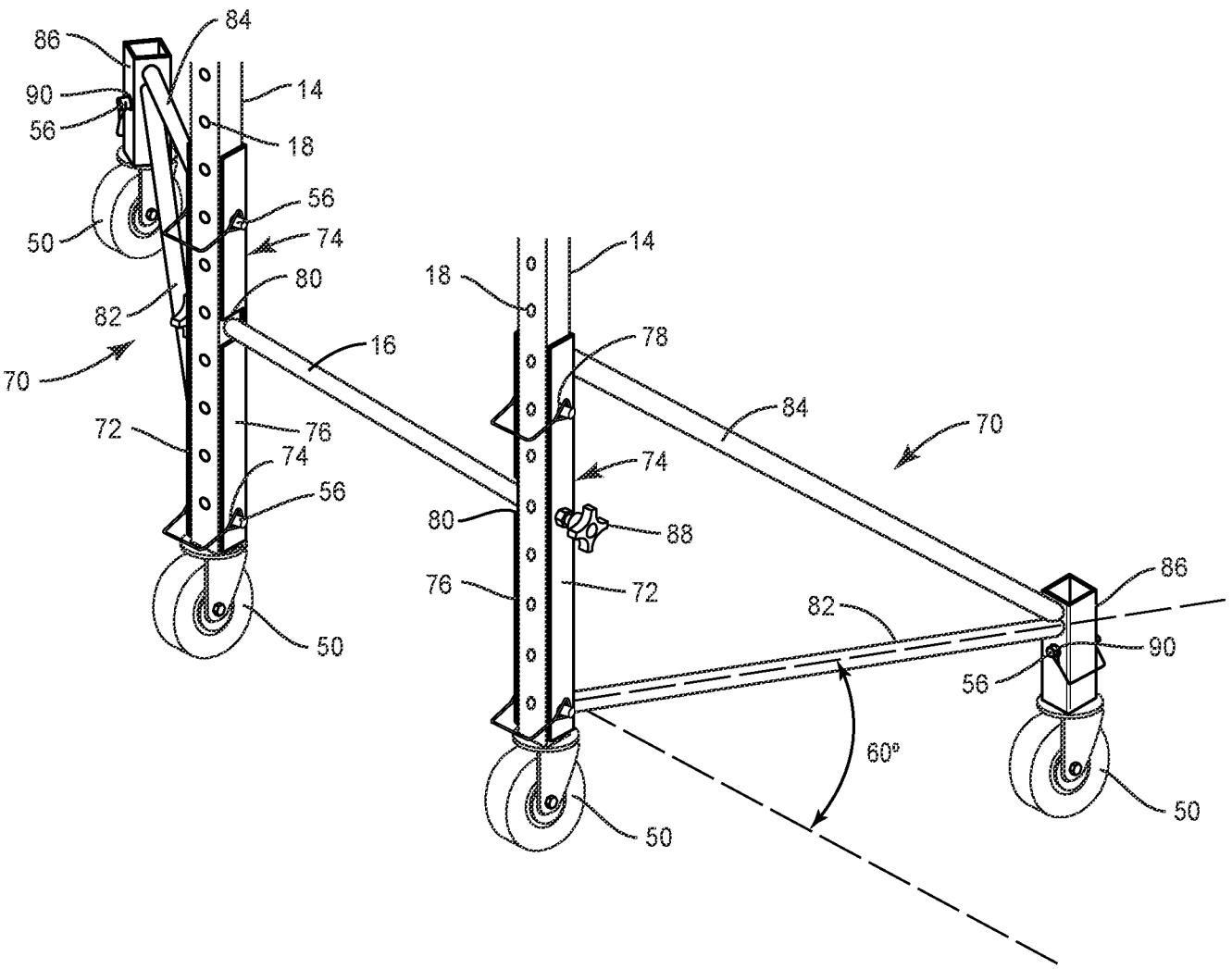
FIG. 8 is a perspective view showing a pair of outriggers attached to a ladder frame in a second orientation.

The first orientation is shown in FIGS. 4 and 7. The second orientation is shown in FIGS. 5, 6 and 8. For clarity, the angle between the outrigger 70 and a reference line extending in the same plane as the ladder frame is 30 degrees in the first orientation and 60 degrees in the second orientation. Those skilled in the art will appreciate that the terms "first" and "second" as used in reference to the orientation are merely arbitrary labels used to name and differentiate the two orientations. Thus, one could switch the labels so that the angle for the first orientation is 60 degrees and the angle for the second orientation is 30 degrees. The remainder of the discussion will use the former labels where the angle for the first orientation is 30 degrees and the angle for the second orientation is 60 degrees.

In the first orientation, the riser 72 fits around the vertical support of the ladder from with the flanges 76 extending along the inner and outer faces of the vertical support. In this orientation, the openings in the flanges 76 align with corresponding openings 18 in the inner and outer faces of the vertical supports 14. the outriggers 70 is secured to the vertical support 14 two or more span pins that pass through the aligned openings 18 and 78 in the vertical supports 14 and channel 74 respectively.

In the second orientation, the riser 72 fits around the vertical support of the ladder from with the flanges 76 extending along the inner and outer faces of the vertical support. In this orientation, the openings in the flanges 76 align with corresponding openings 18*a* in the lateral faces of the vertical supports 14. Also, it will be noted that the cut-outs in the flanges 76 of the riser 72 provide clearance for the cross member 72*s* (rungs) of the ladder frame 12. The outriggers 70 is secured to the vertical support 14 by two or more span pins 56 that pass through the aligned openings 18 and 78.

Figure 9:
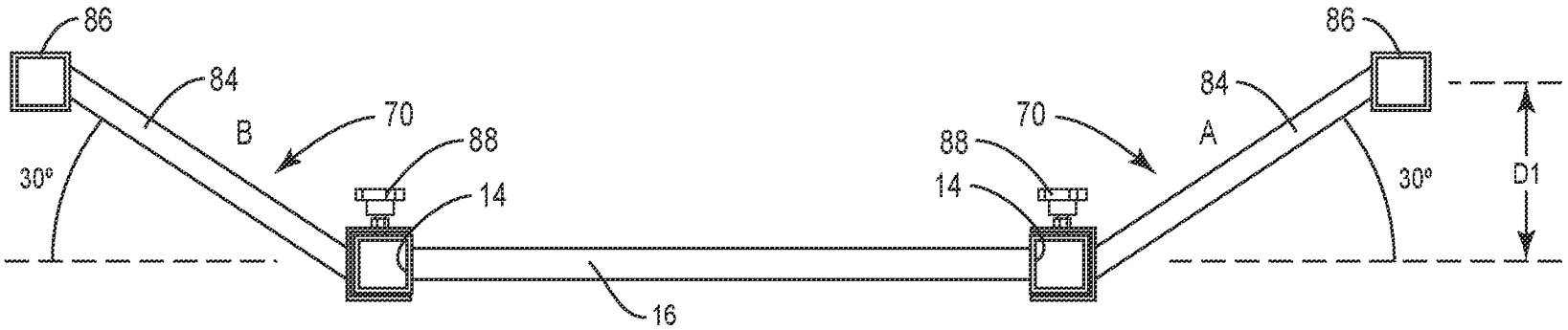
FIG. 9 is a top view showing a pair of outriggers attached to a ladder frame in a first orientation.
Figure 10:
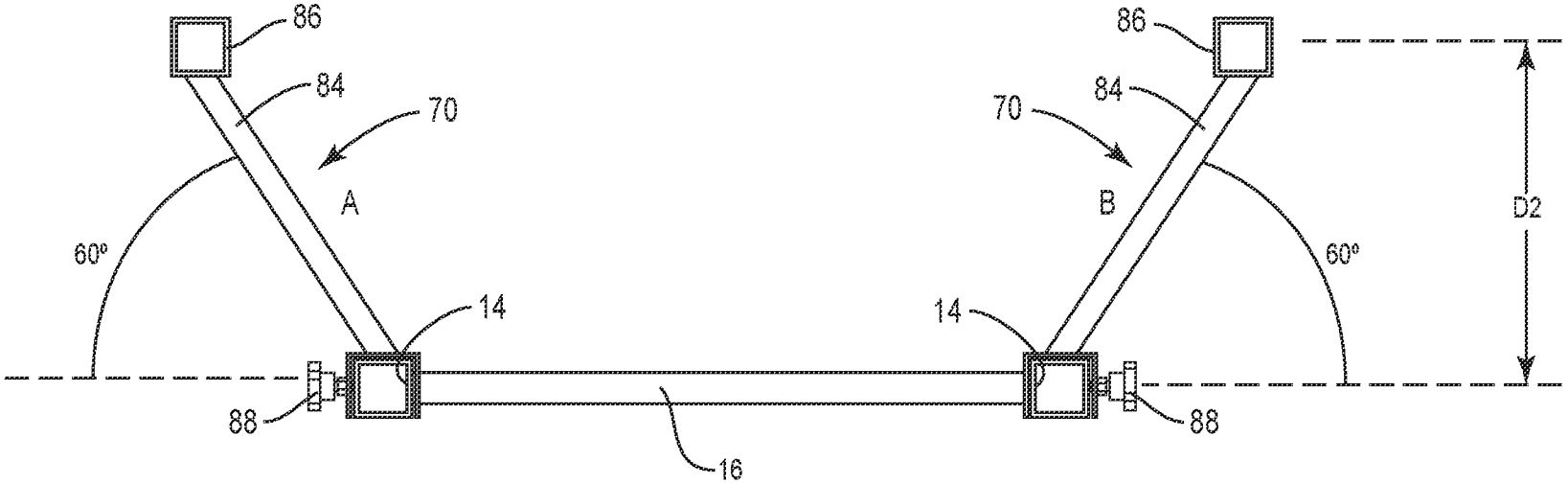
FIG. 10 is a top view showing a pair of outriggers attached to a ladder frame in a second orientation.

Referring to FIGS. 9 and 10, it should be observed that, in order to change between the first and second orientations, the outriggers 70 need to swap sides. In FIGS. 9 and 10, the outriggers 70 are labeled A and B. In the first orientation shown in FIG. 9, outrigger A is on the right side of the Figure and outrigger B is on the left of the Figure. In the first orientation shown in FIG. 10, outrigger B is on the right side of the Figure and outrigger A is on the left of the FIG. 10.

In both the first and second orientations, the outriggers extend outwardly at an angle. The vector of the outrigger includes both a longitudinal component and a lateral component and thus enhances stability in both the longitudinal and lateral dimensions. In the first orientation, the longitudinal component of the outrigger is approximately the length l of the outrigger times the sine of 30 degrees. The lateral component of the outrigger is approximately the length l of the outrigger times the cosine of 30 degrees. In the second orientation, the longitudinal component of the outrigger is approximately the length l of the outrigger times the sine of 60 degrees. The lateral component of the outrigger is approximately the length l of the outrigger times the cosine of 60 degrees. Thus, the first orientation provides greater enhancement in the lateral dimension and less enhancement in the longitudinal dimension compared to the second orientation. On the other hand, the second orientation provides greater enhancement in the longitudinal dimension and less enhancement in the lateral dimension compared to the second orientation. Thus, it will be appreciated that the orientation of the outriggers can be selected depending on where the enhancement is most needed. If greater enhancement in the lateral dimension is needed most, the first orientation can be selected. If greater enhancement in the longitudinal dimension is needed most, the second orientation can be selected.

The outrigger 70 as herein described provides stability enhancement sin both the longitudinal and lateral dimensions. The relative degree of stability enhancement can be selected by choosing between the first and second orientations. Regular use of the outrigger can reduce the risk of accident or injury. The outrigger 70 is simple in construction and requires only minor modification to conventional scaffolding. The only modification that is required is the addition of lateral openings in the vertical supports 14 of the ladder frames 12 to enable mounting in both orientations.

What is claimed is:

1. An outrigger for a scaffold including a pair of ladder frames and an adjustable height platform mounted between the ladder frames, the outrigger comprising:

a riser configured to attach to a vertical support of the ladder frame in both a first orientation and a second orientation, wherein the riser comprises a channel having a central web and a pair of flanges extending outward from opposing edges of the central web, each of the flanges of the channel including a pair of vertically spaced openings that align with a first set of openings in the vertical support in the first orientation and a second set of openings in the vertical support in the second orientation;

an outrigger arm extending outwardly from the vertical support at an angle such that:

in the first orientation, the outrigger arm extends at an angle greater than 0 degrees and less than 45 degrees relative to a transverse plane; and in the second orientation, the outrigger arm extends at an angle greater than 45 degrees relative to the transverse plane; and a sleeve configured for mounting a ground-engaging member mounted at an outer end of the outrigger arm.

2. The scaffold of claim 1, wherein the riser further comprises a cut-out formed in at least one of the flanges providing clearance for a cross member of the ladder frame when the channel is attached to the ladder frame in either the first orientation or the second orientation.

3. The outrigger of claim 1, further comprising a diagonal brace extending from an upper end of the riser to the outrigger arm.

4. An outrigger for a scaffold including a pair of ladder frames and an adjustable height platform mounted between the ladder frames, the outrigger comprising:

a riser configured to attach to a vertical support of the ladder frame, wherein the riser comprises a channel having a central web, a pair of flanges extending outward from opposing edges of the central web, and a cut-out formed in at least one of the flanges providing clearance for a cross member of the ladder frame when the channel is attached to the vertical support of the ladder frame;

an outrigger arm extending outwardly from the riser at an angle relative to a transverse plane such that, when the outrigger is mounted to one of the vertical supports, an outer end of the outrigger extends outward beyond an end of the scaffold in the longitudinal direction;

a diagonal brace extending from an upper end of the riser to the outrigger arm; and a sleeve connected to the outer end of the outrigger arm configured for mounting a ground-engaging member.

5. The outrigger of claim 4, wherein the channel is configured to attach to the vertical support of the ladder frame in both a first orientation and a second orientation.

6. The outrigger of claim 5, wherein each of the flanges of the channel including a pair of vertically spaced openings that align with a first set of openings in the vertical support in the first orientation and a second set of openings in the vertical support in the second orientation.

7. A scaffold comprising:

first and second ladder frames, each ladder frame comprising two vertical supports made of a tubular material connected by two or more cross members;

an adjustable height platform configured to be supported between the first and second ladder frames at a user selected height;

one or more outriggers configured for attachment to respective vertical supports of the ladder frames, each outrigger comprising:

a riser configured to attach to a vertical support of the ladder frame, wherein the riser comprises a channel having a central web, a pair of flanges extending outward from opposing edges of the central web, and a cut-out formed in at least one of the flanges providing clearance for a cross member of the ladder frame when the channel is attached to the vertical support of the ladder frame;

an outrigger arm extending outwardly from the riser at an angle relative to a transverse plane such that, when the outrigger is mounted to one of the vertical supports, an outer end of the outrigger extends outward beyond an end of the scaffold in the longitudinal direction;

a diagonal brace extending from an upper end of the riser to the outrigger arm; and a sleeve connected to the outer end of the outrigger arm configured for mounting a ground-engaging member.

8. The scaffold of claim 7, wherein the channel is configured to attach to the vertical support of the ladder frame in both a first orientation and a second orientation.

9. The scaffold of claim 8, wherein each of the flanges of the channel including a pair of vertically spaced openings that align with a first set of openings in the vertical support in the first orientation and a second set of openings in the vertical support in the second orientation.

* * * * *